US006270311B1

(12) United States Patent
Kuwabara et al.

(10) Patent No.: US 6,270,311 B1
(45) Date of Patent: Aug. 7, 2001

(54) GAS TURBINE SPLIT RING

(75) Inventors: Masamitsu Kuwabara; Yasuoki Tomita; Kiyoshi Suenaga; Masahito Kataoka; Yoshichika Sato; Koji Watanabe, all of Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/518,644

(22) Filed: Mar. 3, 2000

(30) Foreign Application Priority Data

Mar. 3, 1999 (JP) ..... 11-055155

(51) Int. Cl.[7] ..... F01D 1/00
(52) U.S. Cl. ..... 415/110; 415/116; 415/139
(58) Field of Search ..... 415/110, 116, 415/117, 134, 135, 139, 175, 228

(56) References Cited

U.S. PATENT DOCUMENTS 3,970,318 * 7/1976 Tuley ..... 416/139 X
4,063,845 * 12/1977 Allen ..... 415/134
4,650,394 * 3/1987 Weidner ..... 415/115
5,088,888 * 2/1992 Bobo ..... 415/134 X
5,167,485 * 12/1992 Starkweather ..... 415/115
5,374,161 * 12/1994 Kelch et al. ..... 415/116 X

FOREIGN PATENT DOCUMENTS 7-305638 11/1995 (JP) .

* cited by examiner

*Primary Examiner*—John E. Ryznic
(74) *Attorney, Agent, or Firm*—Sughrue, Mion, Zinn, Macpeak & Seas, PLLC

(57) ABSTRACT

In gas turbine split rings, end faces having bent surfaces are formed in flanges. Adjoining split rings are coupled together with a groove therebetween to form a cylindrical split ring. Notches are formed in the flanges. These notches are sealed by inserting a seal plate into the notches of adjoining split rings. A hole for passing cooling air is drilled obliquely in the flange. Cooling air is allowed to flow out along the direction of rotation (of the turbine). This cooling air cools the outlet of the groove due to the effect of film cooling. Because of such cooling, high temperature gas is prevented from staying in this area, cooling effect is enhanced, and hence burning of the end portions can be prevented.

9 Claims, 11 Drawing Sheets

GAS TURBINE SPLIT RING

FIELD OF THE INVENTION

The present invention relates to a gas turbine split ring. More particularly this invention relates to an improvement of cooling at the connection area of the split ring so as to prevent burning of end portions due to the high temperature gas and thus enhance the reliability.

BACKGROUND OF THE INVENTION

FIG. 8 is a general sectional view of a gas turbine. In FIG. 8, reference numeral 31 is a first stage stationary blade, 32 is a flange of the stationary blade, and 33 is its support ring. Reference numeral 34 is a first stage moving blade, 35 is a second stage stationary blade, 36 is a second stage moving blade, 37 is a third stage stationary blade, 38 is a third stage moving blade, 39 is a fourth stage stationary blade, and 40 is a fourth stage moving blade. This example is composed of four stages of blades. One stationary blade is used in each stage. A moving blade is provided between two stationary blades through a disk in the rotor peripheral direction. Thus, a plurality of stationary blades and moving blades are disposed alternately in the axial direction.

In this gas turbine, in order to enhance the turbine efficiency, it is required to elevate the temperature of the working gas. In order to keep the temperature of the metal material of the wall for forming the gas passage below an allowable temperature of the material, holes for passing a cooling air are provided in these member so as to cool the member by passing cooling air. In FIG. 8, reference numeral 20 is a split ring provided in the wall around the first stage moving blade, in which a plurality of arc-shaped rings split on the circumference are coupled to compose a cylindrical wall, and a cooling air hole is provided to cool by passing cooling air.

FIG. 9 is an exploded view of portion B shown in FIG. 8 and shows the split ring in detail. In FIG. 8, the first stage moving blade 34 is disposed between the first stage stationary blade 31 and second stage stationary blade 35, and the split ring 20 is disposed around the circumference of the first stage moving blade 34. In FIG. 9, reference numeral 21 is a cooling air hole provided in the split ring 20. This cooling air hole 21 has an opening 21*a* inside in the upper face, and an opening 21*b* in the side face. Reference numeral 22 is an impinging plate. A cooling air inlet hole 23 is provided above the impinging plate 22 through which cooling air 50 is sent in. The cooling air 50 gets into an inner space 24, and reaches the split ring 20 after passing through the many holes provided in the impinging plate 22. This cooling air cools the surface of the split ring 20, and further flows into the cooling air hole 21 through the opening 21*a*, and flows out to the outside gas passage through the opening 21*b*, thereby cooling the inside of the split ring 20 in this process.

FIG. 10 is a view when seen along the arrows C—C in FIG. 9. This figure shows a part of the split ring 20. The diagram shows the split ring 20 forming a part of the cylindrical structure. Many cooling air holes 21 are arranged in the cylindrical side face. The cooling air holes 21 have opening 21*b*. The inside of the split ring 20 can be cooled by passing cooling air in these holes. The split ring 20 is coupled with adjacent split rings 20*a*, 20*b* and arranged cylindrically, and grooves 26*a*, 26*b* are provided alternately at the connection area, and a seal plate 25 is inserted into the grooves 26*a*, 26*b*, thereby preventing leakage of sealing air.

FIG. 11 is a view when seen along the arrows D—D in FIG. 10. This figure shows a state in which the seal plate 25 is inserted in the grooves at the ends as mentioned above to seal, multiple cooling air holes 21 are formed inside the split ring 20, and the cooling air holes 21 have openings 21*a* at the surface at one side, and openings 21*b* at the side face at the other side, and the cooling air is introduced from the openings 21*a*, and flows out to the gas pass from the openings 21*b*, thereby cooling the wall of the split rings 20.

FIG. 12A and FIG. 12B are magnified views of the seal plate shown in FIG. 10. FIG. 12A is a side view, and FIG. 12B is a view when seen along the arrows E—E in FIG. 12A. As shown in these figures grooves 26*a*, 26*b* are provided in the mutually adjacent split rings 20*b* and 20*a*, and the seal plate 25 is inserted in these grooves. As shown in FIG. 12A, the portions X and Y are groove processed parts of the seal plate 25, and cooling air holes cannot be easily provided in these portions. Consequently, cooling is not sufficient, and the high temperature gas is likely to stay in the space Z between the portions X and Y. Therefore, the portions X and Y are likely to be burnt by the high temperature gas.

FIG. 13A and FIG. 13B show burnt portions X, Y shown in FIG. 12. FIG. 13A is a sectional view, and FIG. 13B is a view when seen along the arrows F—F in FIG. 13A. As shown in these figures, the portions X, Y are exposed to the high temperature gas, and get burnt as indicated by 50, 51. When this state advances, the lower ends of the grooves 26*a*, 26*b* are lost, and the seal plate 25 provided inside may slip out. It has been hence demanded to develop a cooling structure capable of preventing burning of end portions at the connection area of such split ring.

Thus, in the connection area of the conventional gas turbine split rings, it is designed to seal the connection area by the seal plate, and the end portions of such connection area in which grooves are formed for inserting the seal plate are exposed to high temperature combustion gas and burnt, or reduced in wall thickness due to high temperature oxidation, or the end portions are melted and lost, and the seal plate in the grooves may slip out.

SUMMARY OF THE INVENTION

It is an object of the present invention to present a gas turbine split ring characterized by reinforcing the cooling of the end portions for holding the seal plate at the connection area of the split ring, reducing effects of high temperature combustion gas at end portions, and preventing burning of split ring end portions, thereby extending the life of the split ring and enhancing the reliability.

According to one aspect of this invention, the adjacent end faces of the split ring are mutually changed in the peripheral direction between inner side and outer side of the gas pass, and hence are not coupled straightly. At this junction, a specific gap is provided in consideration of thermal expansion, and a seal plate is inserted therein. Therefore, the leak of the cooling air from the connection area at the inner side is prevented by the seal plate. Moreover, since the connection area has a bent gap, it increases the passage resistance of the high temperature combustion gas flowing into the gap from the inner side, so that the structure does not allow invasion of gas easily. Still more, since the oblique cooling air hole is opened in the inner wall near the inside of the connection area, the air flowing out from this opening forms a film for cooling the inner end face at the junction, thereby preventing burning of the inner end portion at the junction.

According to another aspect of this invention, the cooling air hole is opened at the end face near the inner side of the junction. Therefore, the cooling air flows out from the gap at the inner side of the connection area through this opening, which blocks the high temperature gas invading into the gap from the inner side, thereby cooling the gap in the connection area. Moreover, the seal plate is disposed at the inner side of the bent gap of the connection area. Such a seal plate increases the resistance of the passage of air leaking out through the groove in the seal plate from the outer side gap. Therefore, the cooling air hardly leaks.

Further, the other split section end face confronting the opening of the air cooling hole is cut obliquely. Therefore, the air flows out smoothly, and the film cooling effect is enhanced, or by disposing the seal plate at the outer side, the application scope of the design may be expanded as a modified example of the present invention.

Further, a hole is drilled in the seal plate. This hole allows a slight amount of cooling air of outside to flow through the gap in the connection area. Because of this air stream, the high temperature combustion gas staying in the gap is forced to flow inside, and therefore heating of the gap is suppressed and the cooling effect is increased.

Further, the cylindrical split ring is composed by mutually coupling the end faces bent inside of the split sections, in addition to the cooling effect of the end faces, the sealing performance is improved.

Further, the gap between the split rings is partially made narrower between the outer side and inner side. Therefore, the passage resistance in this gap can be increased. As a result, invasion of high temperature combustion gas or cooling air from the inner side can be decreased, and the cooling air leaking from the outer side can be also decreased.

Thus, according to the present invention, burning of the inner end portions of the split section connection area by high temperature combustion gas experienced in the prior art can be prevented, troubles such as slip-out of the seal plate can be avoided, and the reliability of the gas turbine is extremely enhanced.

Other objects and features of this invention will become apparent from the following description with reference to the accompanying drawings.

DESCRIPTION OF THE PREFERRED EMBODIMENTS

Figure 1:
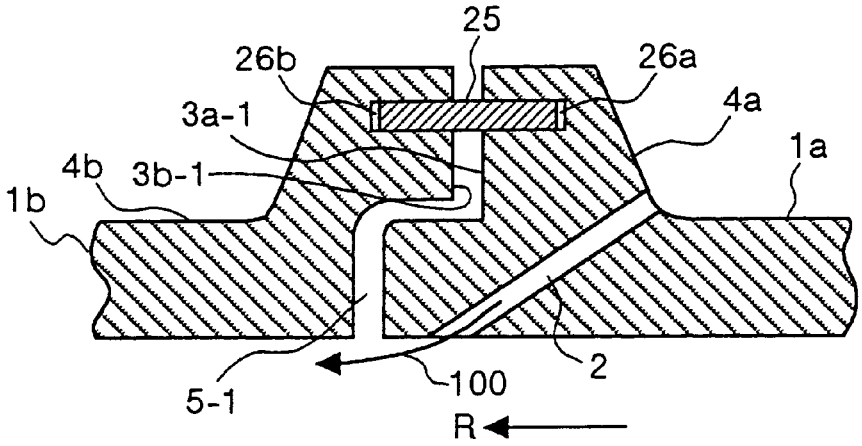
FIG. 1 is a cross sectional view of a gas turbine split ring according to a first embodiment of the present invention.
Figure 10:
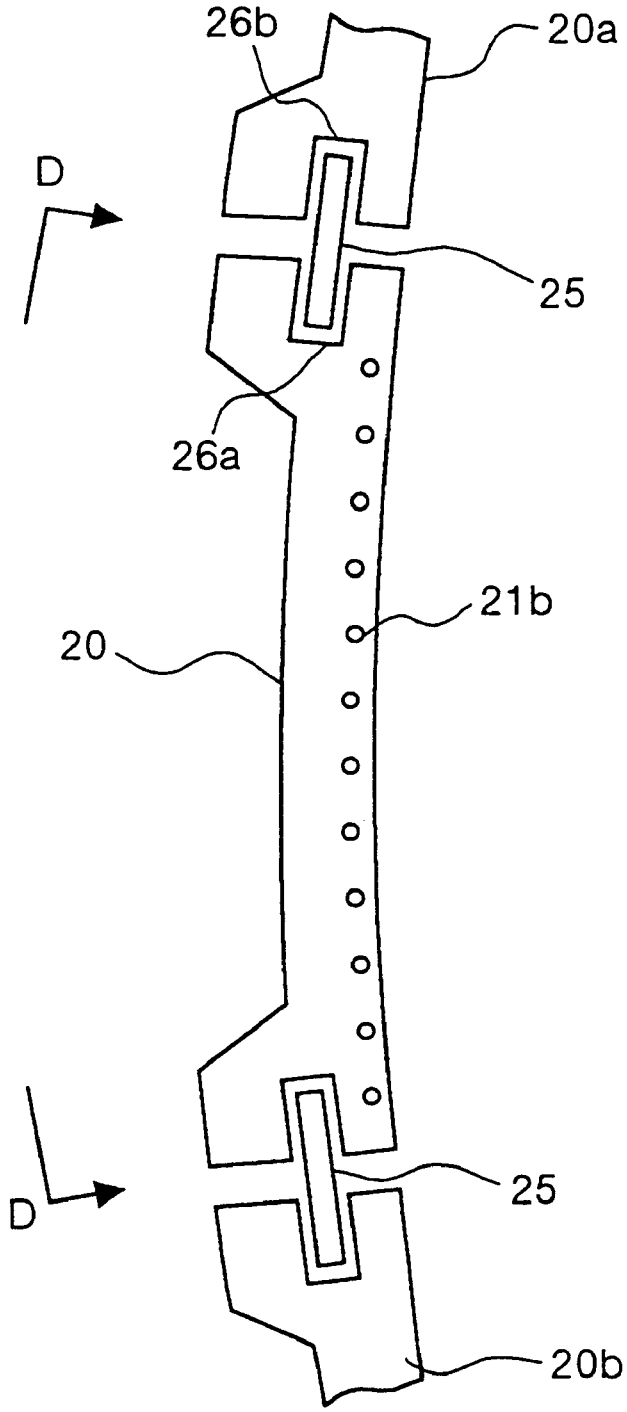
FIG. 10 is a view when seen along the arrows C—C in FIG. 9.
Figure 11:
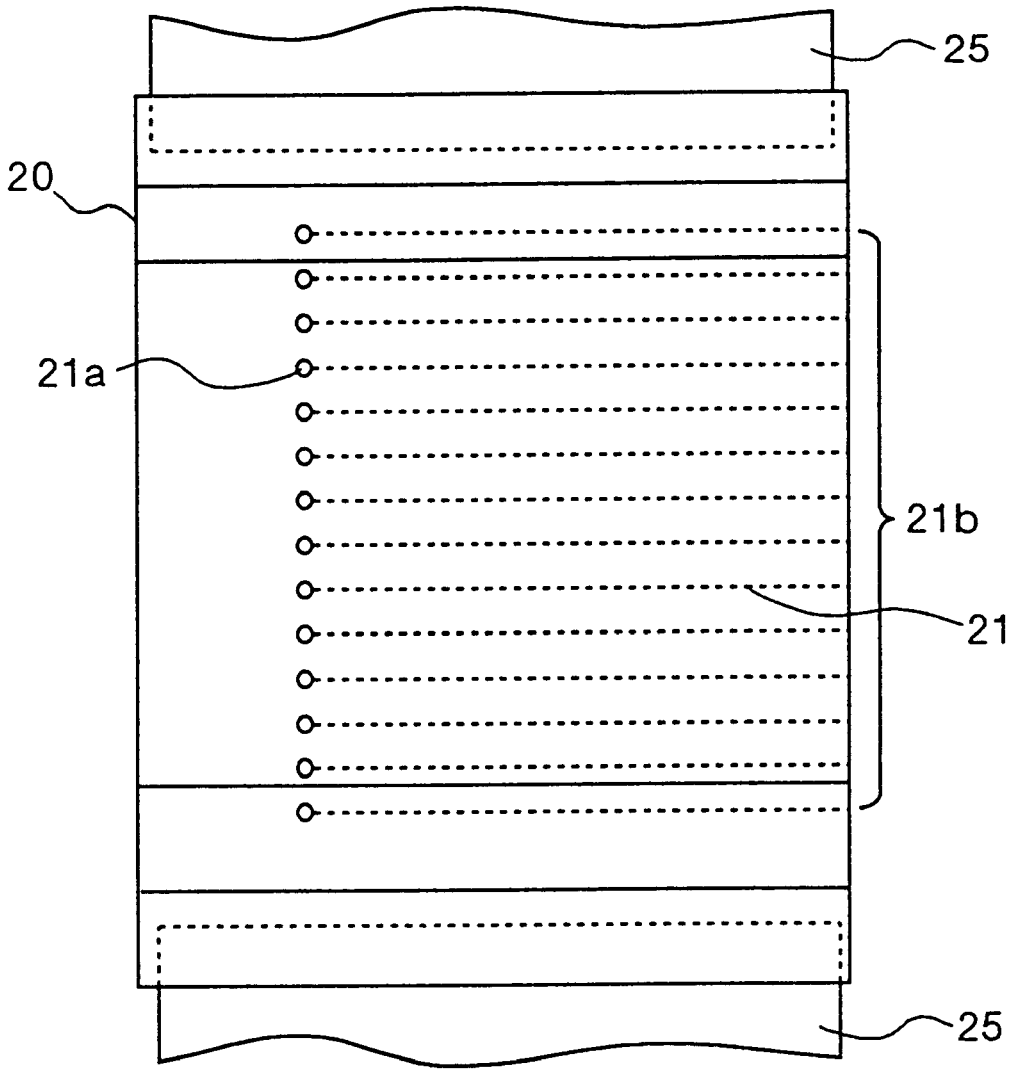
FIG. 11 is a view when seen along the arrows D—D in FIG. 10.
Figure 12A:
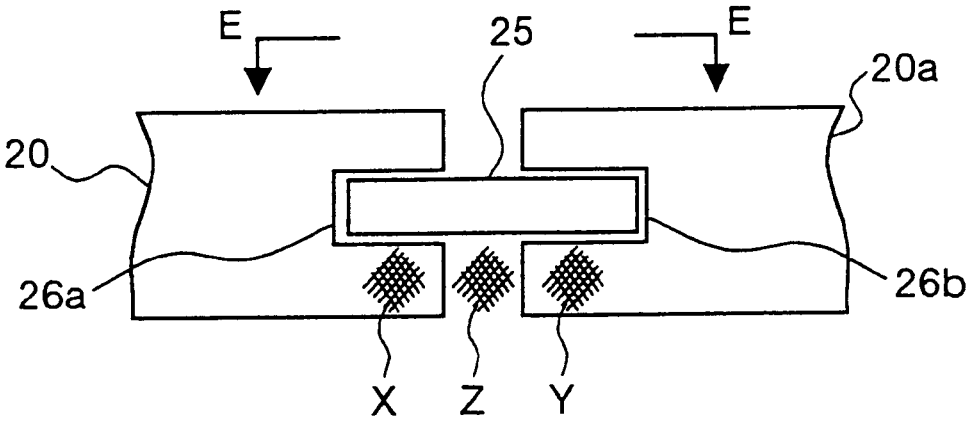
FIG. 12A shows a side view of a connection area of a conventional gas turbine split ring and FIG. 12B a view when seen along the arrows E—E in FIG. 12A.
Figure 12B:
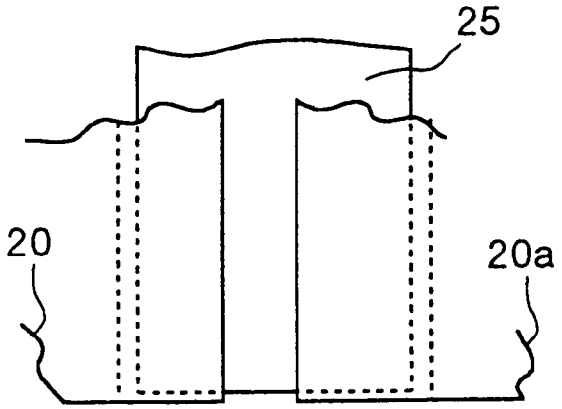
Figure 13A:
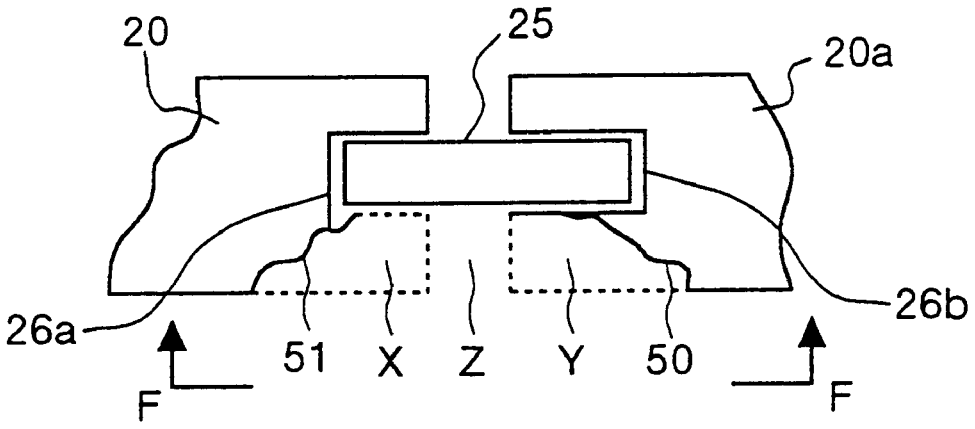
FIG. 13A shows a cross sectional view of a burnt state of the connection area of the conventional gas turbine split ring
Figure 13B:
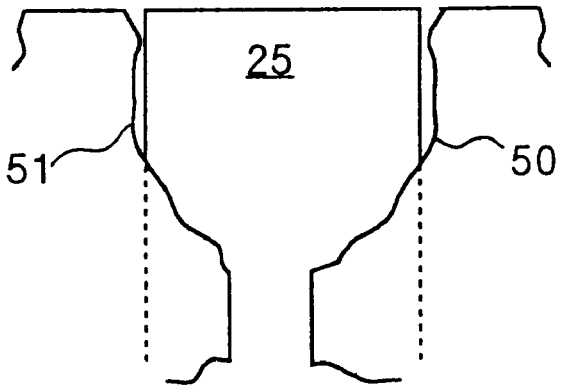
FIG. 13B shows is a view when seen along the arrows F—F shown in FIG. 13B.

Referring now to the drawings, preferred embodiments of the present invention are described in detail below. FIG. 1 is a cross sectional view of a connection area of a gas turbine split ring according to the first embodiment of the present invention, which corresponds to the diagram of the connection portion of the conventional split ring shown in FIG. 10. In this figure, reference numerals 1*a*, 1*b* are split rings, and 2 is a cooling air hole drilled obliquely toward the inner side of the end portion of the split ring 1*a*. About ten cooling air holes 2 are provided at a pitch of 5 mm in the axial direction on the surface of the split ring 1*a*. Reference numerals 3*a*-1 and 3*b*-1 indicate end faces of the split rings. 3*a*-1 indicates the end face of the split ring 1*a*, and is bent and formed so as to form a step in a flange 4*a* toward the peripheral direction. The reference numeral 3*b*-1 similarly indicates the end face of the split ring 1*b*, and forms an end face confronting along the shape of the end face 3*a*-1.

Reference numerals 4*a*, 4*b* indicates flanges, 5-1 indicates a connection area groove formed in the end faces 3*a*-1, 3*b*-1. Reference numeral 25 is a seal plate. Same as in the prior art, the seal plate 25 is inserted into the grooves 26*a*, 26*b* formed in the flanges 4*a*, 4*b*.

In the first embodiment thus constituted, inside of the seal plate 25, by forming the end faces 3*a*-1, 3*b*-1 having steps, the groove 5-1 having a bend is formed. In other words, the end face 3*a*-1 of the split ring 1*a* has a shape such that, inner side (side that is nearer to the center of the cylindrical shape) end portion projects in the peripheral direction as compared to the outer side end portion, and the end face 3*b*-1 of the split ring 1*b* has a shape opposite to the shape of the end face 3*a*-1. That is, the end face 3*b*-1 has a shape such that, outer side (side that is away from the center of the cylindrical shape) end portion projects in the peripheral direction as compared to the inner side end portion. Because of such a shape of the groove 5-1, resistance is given to the stream of the cooling air flowing out from the grooves 26*a*, 26*b*, and the sealing performance is improved. Further, the high temperature combustion gas hardly invades into the gap. Further, from the inclined cooling air hole 2, the cooling air 100 flows in from the outside of the split ring 1*a* toward the rotating direction R of the rotor. The inner side end portion of the connection area groove 5-1 is cooled by such film cooling, and the gas stagnant region at the inner side of the connection area groove 5-1 is effectively cooled, thereby preventing burning of this portion by the high temperature combustion gas. Therefore, troubles of slip-out of the seal plate 25 can be prevented, and the reliability of the split ring is enhanced.

Figure 2:
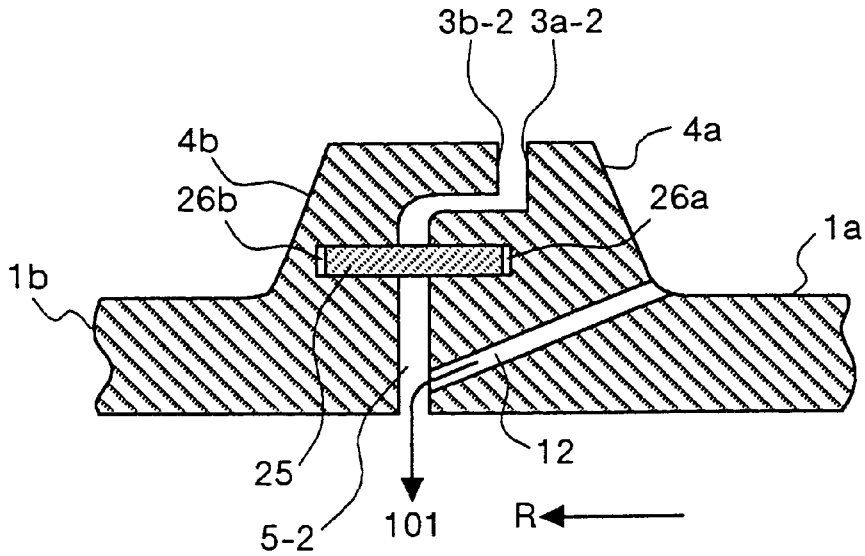
FIG. 2 is a cross sectional view of a gas turbine split ring according to a second embodiment of the present invention.

FIG. 2 is a cross sectional view of a gas turbine split ring according to the second embodiment of the present invention. The difference between the first embodiment shown in FIG. 1 is that the seal plate 25 is disposed at the inner side of the bent in the groove 5-2, while the outlet of a cooling air hole 12 is inside of the groove 5-2. That is, end faces 3*a*-2, 3*b*-2 having a curvature are formed in the flanges 4*a*, 4*b* of the split rings 1*a*, 1*b*. The end faces of the split ring then forms the groove 5-2.

The bent passage of the connection area groove 5-2 is moved to the upper part (outer side) in comparison to the example shown in FIG. 1, the grooves 26*a*, 26*b* are provided at the inner side of the bent passage, and the seal plate 25 is disposed at the inner side of the example in FIG. 1. The cooling air hole 12 is drilled obliquely from the outer side to the inner side in the flange 4*a*, and its outlet is inside the groove 5-2.

According to thus constituted second embodiment, the inlet passage resistance of the cooling air flowing in from the outer side is increased at the outer opening of the bent groove 5-2, and air leak from the surrounding grooves 26*a*, 26*b* of the seal plate 25 can be decreased. Further, the air 101 flowing into the cooling air hole 12 from the outer side of the split ring 1*a* flows into the groove 5-2, and flows out into the gas pass from the groove outlet, thereby cooling the surrounding of the end portion of the groove 5-2. Since the cooling air flows out into the groove in the inner opening of the groove 5-2, counterflow of the high temperature combustion gas into the passage in the groove 5-2 from the connection area opening to the seal plate 25 is prevented, and the cooling effect of the end face is enhanced.

Figure 3:
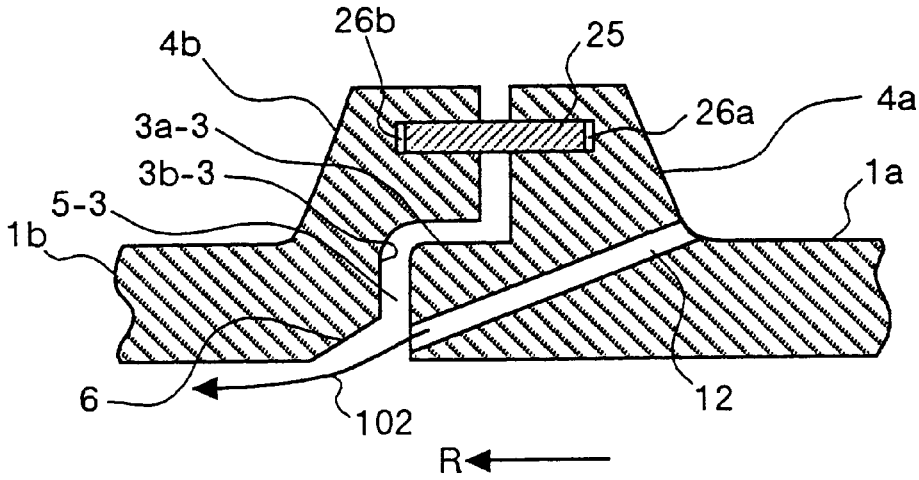
FIG. 3 is a cross sectional view of a gas turbine split ring according to a third embodiment of the present invention.

FIG. 3 is a cross sectional view of a gas turbine split ring according to the third embodiment of the present invention. The characteristic of the third embodiment is that the outlet of the cooling air hole 12 of the first embodiment shown in FIG. 1 is moved inside of the groove near the opening of the connection area groove 5-3 same as in the example shown in FIG. 2, and that a notch 6 is provided by cutting off the end portion of the split ring 1*b* confronting the opening of the cooling air hole 12 of the connection area groove 5-3 obliquely in the direction of rotation R.

That is, the grooves 26*a*, 26*b* and seal plate 25 are the same as those shown in FIG. 1, and the shape of end faces 3*a*-3, 3*b*-3 is also same. However, the notch 6 is formed at the inner end face of the end face 3*b*-3 as described above. The cooling air hole 12 is drilled in the flange 4*a* obliquely from the outer side in the same manner as shown in FIG. 2, and is opened inside the groove 5-3, and the end face 3*b*-3 confronting this opening is cut obliquely to form the notch 6.

In thus constituted third embodiment, by the bent passage of the groove 5-3, the sealing performance of the air flowing out is enhanced same manner as in the first embodiment shown in FIG. 1. Further, the air 102 flowing out from the cooling air hole 12 smoothly flows out along the slope of the notch 6, and the two end portions can be effectively cooled by film cooling due to a film formed of this cooling air. Further, in this embodiment, since the outlet of the cooling air 102 is shifted to the inner side of the groove 5-3 as compared with the first embodiment shown in FIG. 1, entry of the high temperature gas flowing back into the groove 5-3 can be prevented.

Figure 4:
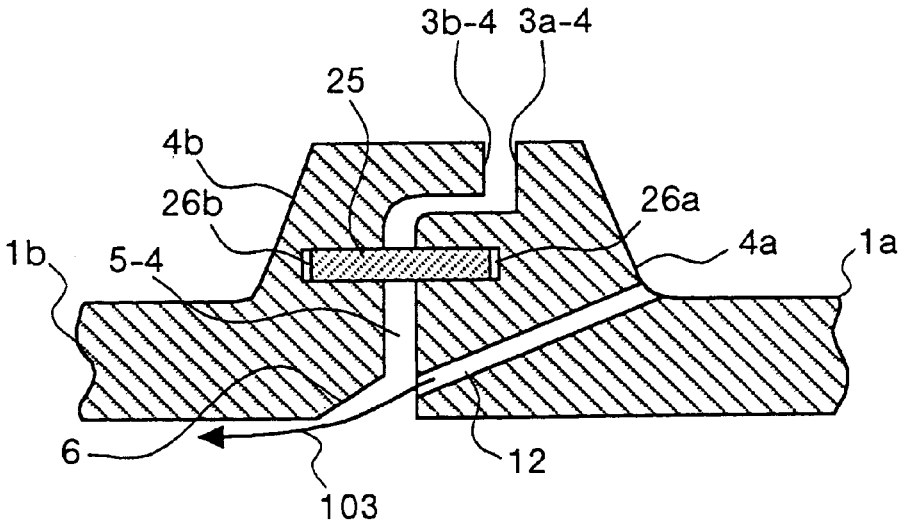
FIG. 4 is a cross sectional view of a gas turbine split ring according to a fourth embodiment of the present invention.

FIG. 4 is a cross sectional view of a gas turbine split ring according to the fourth embodiment of the present invention. This embodiment is similar to the second embodiment shown in FIG. 2, except that a notch 6 is further provided. The remaining structure is the same as the one shown in FIG. 2. That is, the configuration of grooves 26*a*, 26*b*, and seal plate 25 is same as that shown in FIG. 2. Further, the shape of end faces 3*a*-4, 3*b*-4 is also the same. However, the notch 6 is formed by cutting off obliquely at the inner side end of the end face 3*b*-4. The cooling air hole 12 is drilled obliquely from the outer side in the flange 4*a*, and has an outlet inside of the groove 54, and the end face 3*b*-4 confronting this opening is the obliquely cut notch 6.

Thus constituted fourth embodiment has the same action and effect as the second embodiment, and moreover the air 103 flowing out from the cooling air hole 12 flows out smoothly along the slope of the notch 6, and the two ends portions are cooled effectively. More specifically, the end portion of the split ring 1*b* is cooled by film cooling by the slope of the notch 6, and the cooling effect in this portion is increased.

Figure 5:
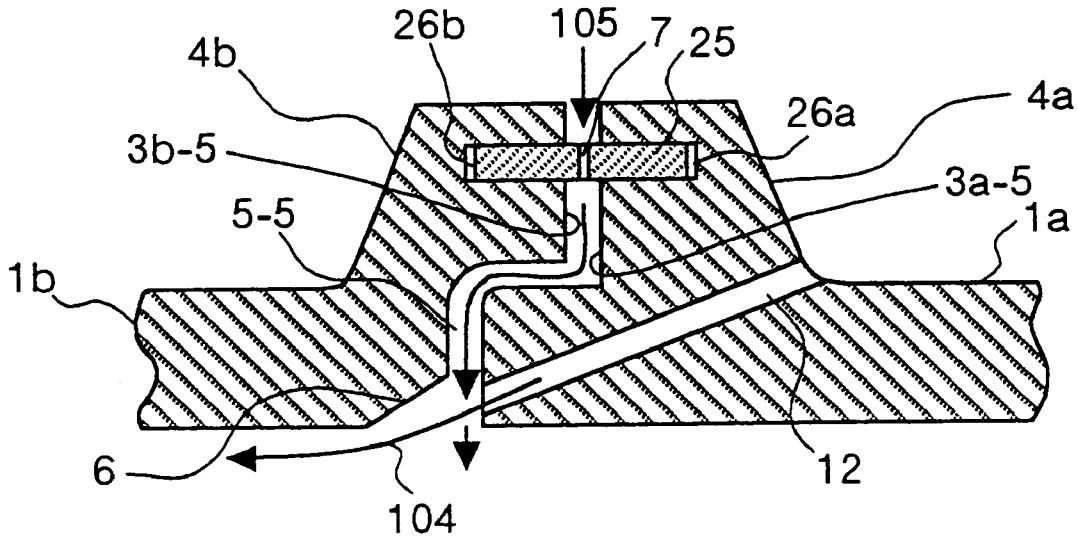
FIG. 5 is a cross sectional view of a gas turbine split ring according to a fifth embodiment of the present invention.

FIG. 5 is a cross sectional view of a gas turbine split ring according to the fifth embodiment of the present invention. The constitution of this embodiment is the same as that of the third embodiment shown in FIG. 3, except that a fine air vent 7 is formed in the seal plate 25. That is, the positions of the grooves 26*a*, 26*b*, the seal plate 25, the cooling air hole 12, the end faces 3*a*-5, 3*b*-5, and the notch 6 are the same as those shown in FIG. 3. The groove 5-5 is also formed in the same manner.

The air vent 7 is opened in the seal plate 25, and it connects through a flow path the outer side and inner side of the groove 5-5 partitioned by the seal plate. The section from the intermediate seal plate 25 of the connection area groove 5-5 and the notch 6 is closed due to the air 104 flowing out from the outlet of the cooling air hole 12, and the high temperature gas is packed in this portion and remains stagnant without flowing. However, this gas is driven out due to the convection by the air 105 flowing in from the air vent 7 toward the inner side, thereby suppressing the retention of the gas inside the groove, and the cooling effect of the end faces 3*a*-5, 3*b*-5 is further enhanced. Since this air vent 7 has an effect on the sealing performance of the seal plate 25, it is formed as a fine hole, and it allows only a slight leak of air as the means of provoking convection in the groove, and therefore the hole diameter is defined as not to spoil the sealing performance. The other action and effect are same as in the third embodiment shown in FIG. 3.

Figure 6A:
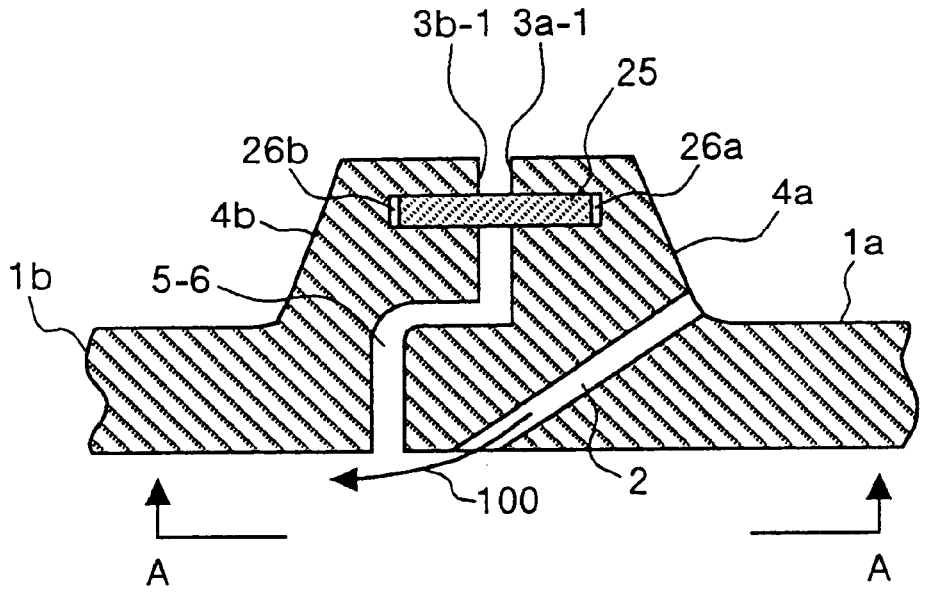
FIG. 6A shows a cross-sectional view of a gas turbine split ring according to a sixth embodiment of the present invention.
Figure 6B:
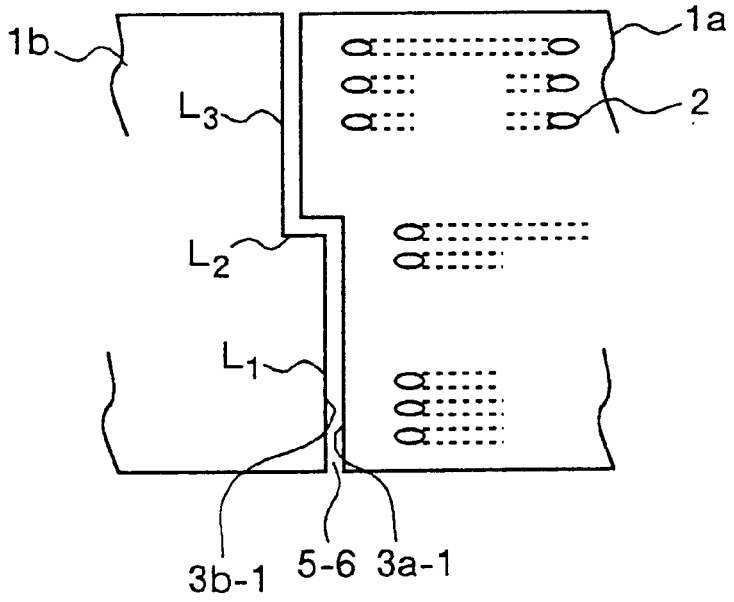
FIG. 6B shows a view when seen along the arrows A—A shown in FIG. 6A.

FIG. 6A and FIG. 6B show a gas turbine split ring according to the sixth embodiment of the present invention. FIG. 6A is a cross sectional view, and FIG. 6B is a view when seen along the arrows A—A shown in FIG. 6A. The characteristic of this embodiment is the shape of the groove. In order to explain this embodiment, FIG. 6A shows the split ring in the first embodiment, however this embodiment can similarly be applied to the split rings in the second to fifth embodiments.

Since FIG. 6A is the same as FIG. 1 its explanation is omitted. As shown in FIG. 6B, the end faces 3*a*-1, 3*a*-2 of the split rings 1*a*, 1*b* are composed of portions $L_1$, $L_2$, $L_3$. $L_1$ and $L_3$ are straight lines in the axial direction, and $L_2$ is a straight line orthogonal to the straight lines $L_1$, $L_3$, and forming a surface bent at right angle. Therefore, the groove 5-6 formed of the both end faces 3*a*-1, 3*b*-2 is formed of a circulating route bent at right angle in the middle.

By forming the groove 5-6 in this manner, the path in the connection area of the split rings in the first to fifth embodiments becomes complicated. Therefore, the resistance is increased and the leak of cooling air is decreased. Further, entry of the high temperature combustion gas from the inner side into the connection area groove is limited, and the cooling effect is enhanced.

Figure 7:
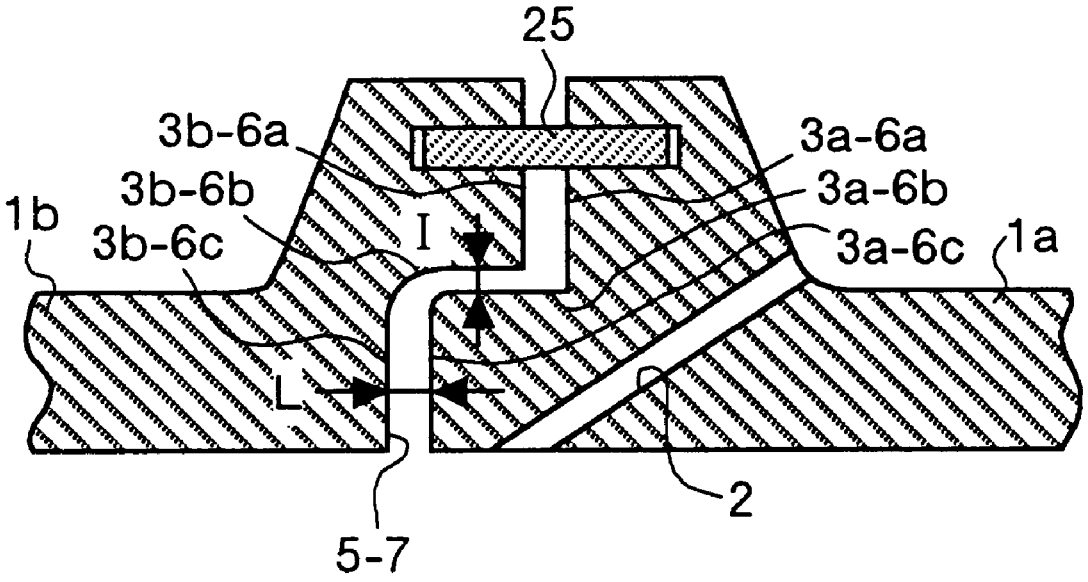
FIG. 7 is a cross sectional view of a gas turbine split ring according to a seventh embodiment of the present invention.
Figure 8:
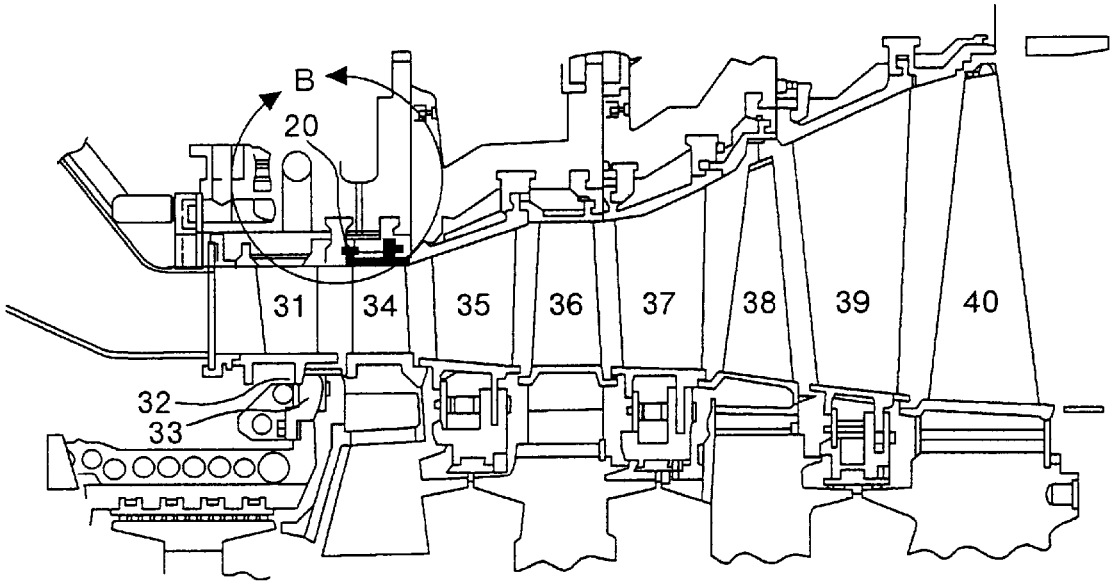
FIG. 8 is a general block diagram of a gas turbine.
Figure 9:
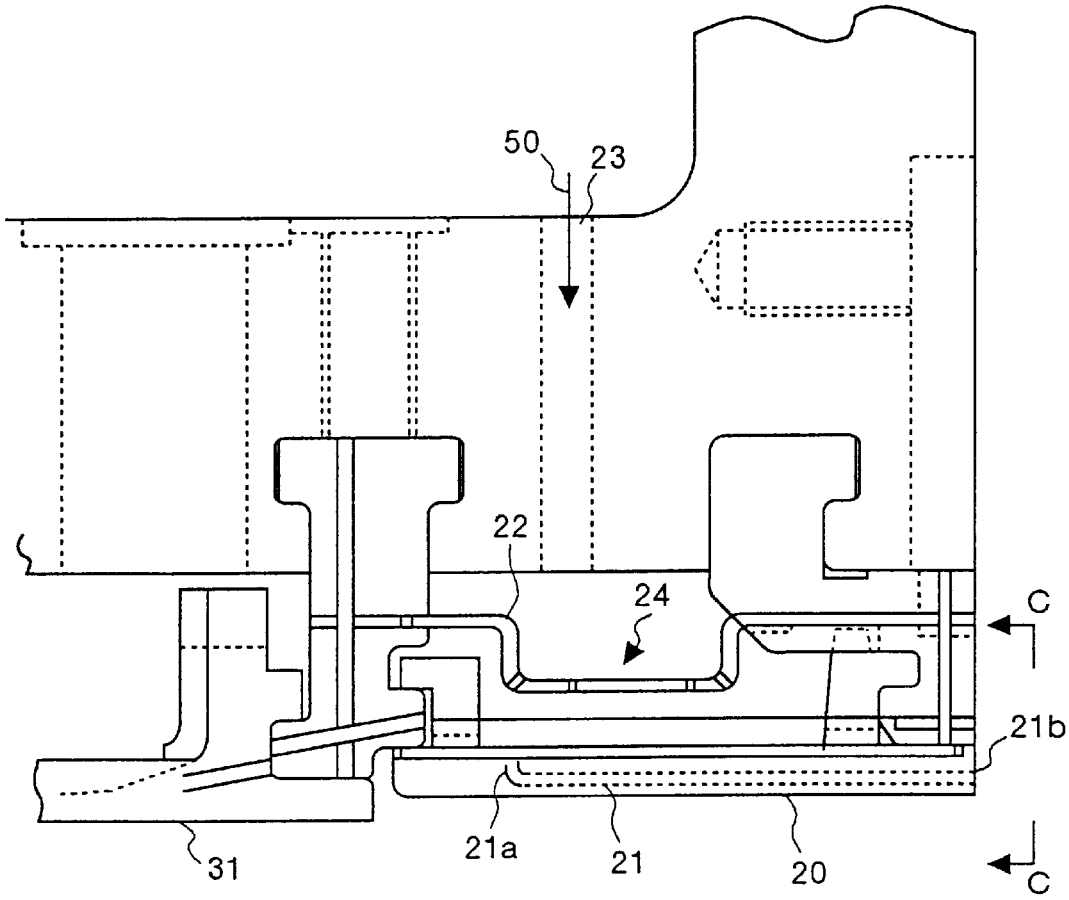
FIG. 9 is an exploded cross sectional view of the portion B in FIG. 8.

FIG. 7 is a cross sectional view of a gas turbine split ring according to the seventh embodiment of the present invention. The difference between this embodiment and the first embodiment shown in FIG. 1 is that the width of the groove 5-7 is partially narrow as compared to the same in the outer side and inner side of the groove. That is, the end face of the split ring 1*a* is composed of three parts, 3*a*-6*a*, 3*a*-6*b*, 3*a*-6*c*, from the outer side, and similarly the end face of the split groove 1*b* is composed of three parts, 3*b*-6*a*, 3*b*-6*b*, 3*b*-6*c*, from the outer side, and the groove width is varied in the portion composed of 3*a*-6*b* and 3*b*-6*b*.

The width of the groove composed of the end faces 3*a*-6*a* and 3*b*-6*a* or the width of the groove composed of end faces 3*a*-6*c* and 3*b*-6*c* is considered to be L. Further, the width of groove composed of the end faces 3*a*-6*b* and 3*b*-6*b* is considered to be I. It is a feature of the seventh embodiment of the present invention that the groove widths L and I are such that there is relation of L>I. In FIG. 7, the groove 5-7 is shown to be narrow only in the portion formed in the peripheral direction, but it is enough as far as there is a narrow portion between the outer side and inner side of the groove 5-7, and it is not always required to be narrow only in the peripheral direction.

In thus constituted seventh embodiment, the passage resistance of the groove 5-7 formed at both ends can be increased. When the passage resistance is increased, invasion of high temperature combustion gas or cooling air from inside can be decreased, and the amount of cooling air leaking out from the outer side can be also decreased. As a result, the film cooling around the cooling air hole 2 by cooling air is more effective, and burning of this portion due to high temperature combustion gas is prevented, and also slip-out troubles of the seal plate 25 are avoided, and the reliability of the split ring is enhanced.

As explained above, according to the gas turbine split ring of the present invention burning of inner side end portion of the connection area of the split sections forming the spilt ring is prevented, and slip-out troubles of the seal plate placed in the connection area is avoided.

Further, in a another aspect of the present invention, the cooling air hole is provided in such a manner that it opens at the end face of the junction, and the seal plate is disposed at the inner side of the projecting shape portion. Therefore, in addition to the aforesaid effect, since the cooling air flows out from the gap at the inner side of the connection area, high temperature gas is prevented from entering into the gap from inside, and the connection area gap can be cooled effectively.

Further, the end face of other split section confronting the opening of the cooling air hole is cut obliquely to the slope of the cooling air hole. Therefore, the air flows out smoothly, and the film cooling effect of the present invention is further improved, or by disposing the seal plate at the outer side, the application scope of the design may be expanded as a modified example of the present invention.

Further, a hole is drilled in the seal plate. This hole allows a slight amount of cooling air of outside to flow through the gap in the connection area. Because of this air stream, the high temperature combustion gas staying in the gap is forced to flow inside, and therefore heating of the gap is suppressed and the cooling effect is increased.

Further, the cylindrical split ring is composed by mutually coupling the end faces bent inside of the split sections. Therefore, in addition to the cooling effect of the end faces, the sealing performance is improved.

Moreover, the gap formed by mutually confronting ends is partially narrower between the outer side and inner side, the passage resistance in this gap can be increased. Therefore, when disposing the seal plate at the outer side of this narrow gap, it is effective to decrease the invasion of high temperature combustion gas or cooling air mainly from the inner side can be decreased. On the other hand, when the seal plate is disposed at the inner side of this narrow gap, the cooling air leaking mainly from the outer side can be also decreased. Further, when a hole is opened in the seal plate, by increasing the passage resistance of the gap, similar effects are obtained, and it is also effective to prevent flow of massive cooling water into the hole of the seal plate.

Thus, according to the present invention, burning of the inner end portions of the split section connection area by high temperature combustion gas experienced in the prior art can be prevented, troubles such as slip-out of the seal plate can be avoided, and the reliability of the gas turbine is extremely enhanced.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A gas turbine split ring comprising a plurality of split segments and seal plates, wherein said split segments are coupled to form a cylindrical shape by inserting an end portion of one seal plate into a connection portion of two adjoining split segments, wherein said connection portion has a shape such that, inner side (side that is nearer to the center of the cylindrical shape) end portion of a split segment projects in the peripheral direction as compared to the outer side end portion, the split segment adjoining to this split segment has a connection portion whose shape is opposite to the shape of the connection portion of this split segment, and the adjoining split segments are so coupled that there is a specific gap therebetween, a hole for passing a cooling air is provided in the connection portion of the split segment in such a manner that it is drilled obliquely from outer side towards the connection portion and opens on the inner surface of the connection portion.

2. The gas turbine split ring according to claim 1, wherein the end face of the connection portion in the axial direction of said split segment is bent by forming a nearly orthogonal end face at an intermediate position.

3. The gas turbine split ring according to claim 1, wherein said gap is partially narrow at a portion between the outer side and the inner side.

4. A gas turbine split ring comprising a plurality of split segments and seal plates, wherein said split segments are coupled to form a cylindrical shape by inserting an end portion of one seal plate into a connection portion of two adjoining split segments, wherein said connection portion has a shape such that, inner side (side that is nearer to the center of the cylindrical shape) end portion of a split segment projects in the peripheral direction as compared to the outer side end portion, the split segment adjoining to this split segment has a connection portion whose shape is opposite to the shape of the connection portion of this split segment, and the adjoining split segments are so coupled that there is a specific gap therebetween, a hole for passing a cooling air is provided in the connection portion of the split segment in such a manner that it is drilled obliquely from outer side towards the connection portion and opens in the gap between the adjoining split segments.

5. The gas turbine split ring according to claim 4, wherein the end face of a split segment confronting the said hole for passing a cooling air of adjoining split segment is cut obliquely with respect to the slope of said hole for passing a cooling air.

6. The gas turbine split ring according to claim 4, wherein said seal plate is disposed at the outer side, instead of the inner side of said projecting shape portion.

7. The gas turbine split ring according to claim 6, wherein a hole is drilled in said seal plate, and this hole allows air to flow through the gap between the adjoining split segments from the outer side to the inner side.

8. The gas turbine split ring according to claim 4, wherein the end face of the connection portion in the axial direction of said split segment is bent by forming a nearly orthogonal end face at an intermediate position.

9. The gas turbine split ring according to claim 4, wherein said gap is partially narrow at a portion between the outer side and the inner side.

* * * * *